US006138933A

United States Patent [19]

Chevalier et al.

[11] Patent Number: 6,138,933

[45] Date of Patent: Oct. 31, 2000

[54] CRUSHERS WITH RING-SHAPED TRACK AND ROLLER

[75] Inventors: Philippe Chevalier, Boissets; Alain Cordonnier, Lille; Philippe Lagache, Isle d'Abeau; Christophe Obry, Steenwerck, all of France

[73] Assignee: FCB, Montreuil, France

[21] Appl. No.: 09/403,242

[22] PCT Filed: Apr. 15, 1997

[86] PCT No.: PCT/FR97/00682

§ 371 Date: Nov. 2, 1999

§ 102(e) Date: Nov. 2, 1999

[87] PCT Pub. No.: WO98/46357

PCT Pub. Date: Oct. 22, 1998

[51] Int. Cl.[7] ..... B02C 13/20

[52] U.S. Cl. ..... 241/261.1; 241/228

[58] Field of Search ..... 241/228, 261.1, 241/259.1, 259.2, 259.3, 260, DIG. 10, 172, 1, 301

[56] References Cited

FOREIGN PATENT DOCUMENTS 614964 7/1933 Germany .

*Primary Examiner*—Mark Rosenbaum
*Attorney, Agent, or Firm*—Harrison & Egbert

[57] ABSTRACT

A grinder having an annular track with a horizontal axis (14), a roller (16) capable of travelling over the track, a mechanism for pressing the roller against the track and means (18) for displacing the material from one edge of the track to the other in such a way that it passes several times beneath the roller before being evacuated. To enhance the efficiency of the grinder and the distribution of mechanical stresses in the roller and the track, the track (14) and the roller (16) are designed in such a way that the gap between them decreases from the edge of the track (14) located on the side for supplying the material to be ground to a distance from this edge at least equal to 80% of the width of the track, and in that this interval then swiftly increases to form a decompression area (19) on the ground material evacuation side.

5 Claims, 3 Drawing Sheets

CRUSHERS WITH RING-SHAPED TRACK AND ROLLER

TECHNICAL FIELD

The present invention relates to grinders comprising an annular track with a horizontal axis, a roller capable of travelling over the said track, means for pressing the roller against the track and means for displacing the material from one edge of the track to the other, in such a way that it can pass several times beneath the roller before being evacuated.

BACKGROUND ART

To enhance grinding when the materials to be ground are of heterogeneous grain sizes, it is proposed (French patent No. 91.09788) to give the roller and/or the track a profile such that the gap between the roller and the track decreases progressively or by degrees from one edge of the track to the other.

The object of the present invention is to enhance the efficiency of the grinders of this type and to achieve a better distribution of the mechanical stresses in the roller and the track.

SUMMARY OF THE INVENTION

The grinder to which the present invention relates is characterized in that the gap between the roller and the track decreases from the edge of the track located on the side for feeding the material to be ground to a distance from the said edge at least equal to 80% of the width of the track, and then increases more quickly to form an area of decompression on the ground material evacuation side.

According to a preferred form of embodiment, the track is constituted by a ring integral with a drum having a horizontal axis which forms a supply chamber on one side of the track and an evacuation chamber on the other side, and an annular barrier is provided at the end of the evacuation chamber opposite that adjoining the track to maintain in the said chamber a layer of ground material the thickness of which is such that it practically reaches the edge of the roller in the plane of the adjacent edge of the track.

Preferably, the axial extent of the decompression area counting from the edge of the track located on the material evacuation side, is between 2% and 20%, preferably 5% and 15%, of the width of the track, and, in this area, the angle formed by the track and the peripheral surface of the roller, in the plane containing the axes of the track and the roller, is less than 50°.

According to one form of embodiment of the grinder, the track is cylindrical and the roller is formed by at least two frustoconical parts, a first part the diameter of which increases from its end located on the supply side to a distance from this end at least equal to 80% of the axial length of the roller, and a second part of decreasing diameter located at its other end.

Alternatively, the track can have a frustoconical profile with a diameter that decreases from its edge located on the side for supplying the material to be ground to the decompression area and a constant or variable angle at the apex; in the decompression area, the diameter of the track increases in the direction of progress of the material. With such a track, use can be made of a cylindrical roller the axis of which will be parallel with axis of the track or will form an angle of less than 5° therewith.

BRIEF DESCRIPTION OF THE DRAWINGS

The description that follows refers to the accompanying drawings which show, by way of non-limitative examples, several forms of embodiment of the invention, and in which.

Figure 1:
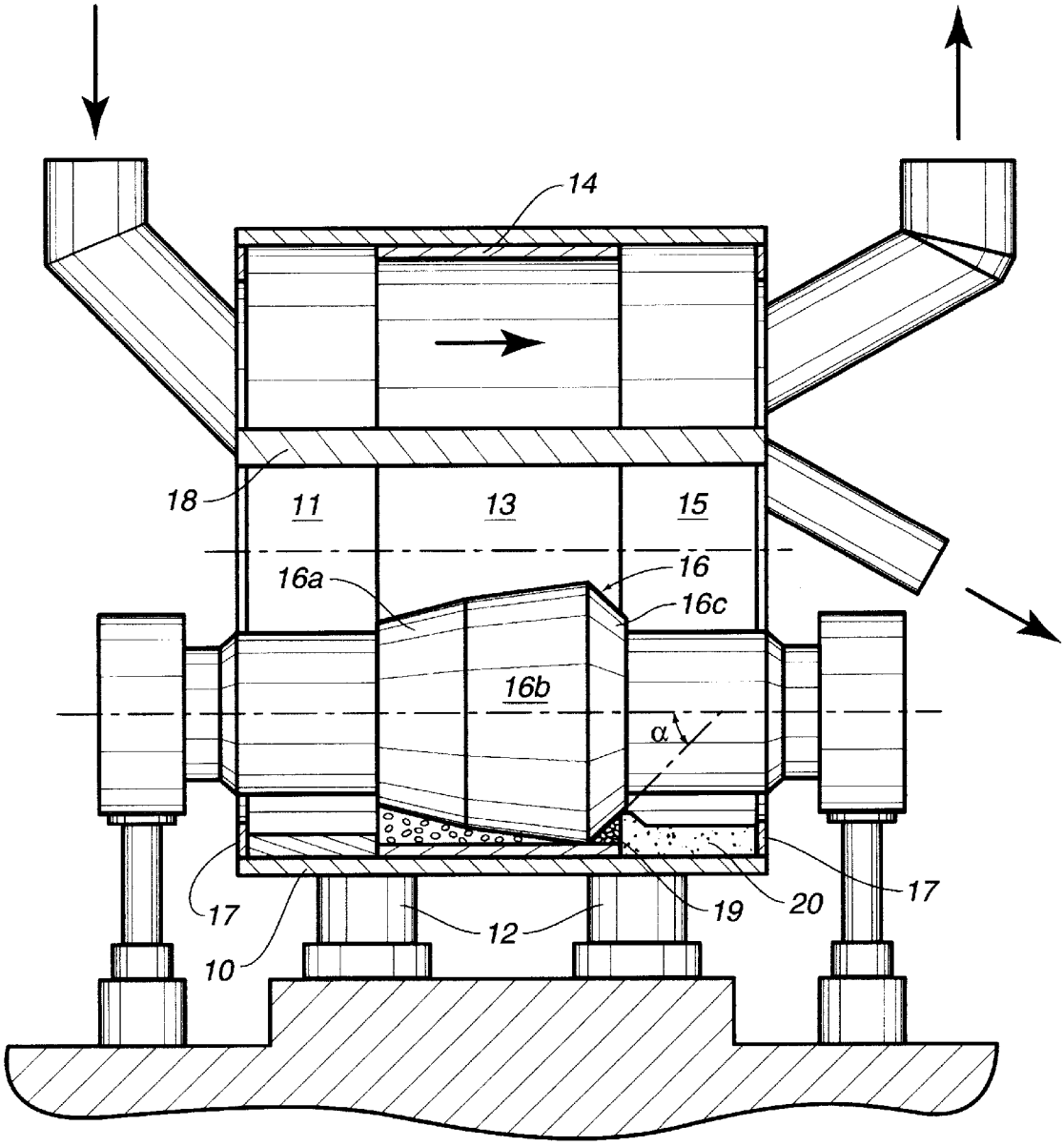
FIG. 1 is a vertical section of a grinder produced according to the invention.
Figure 2:
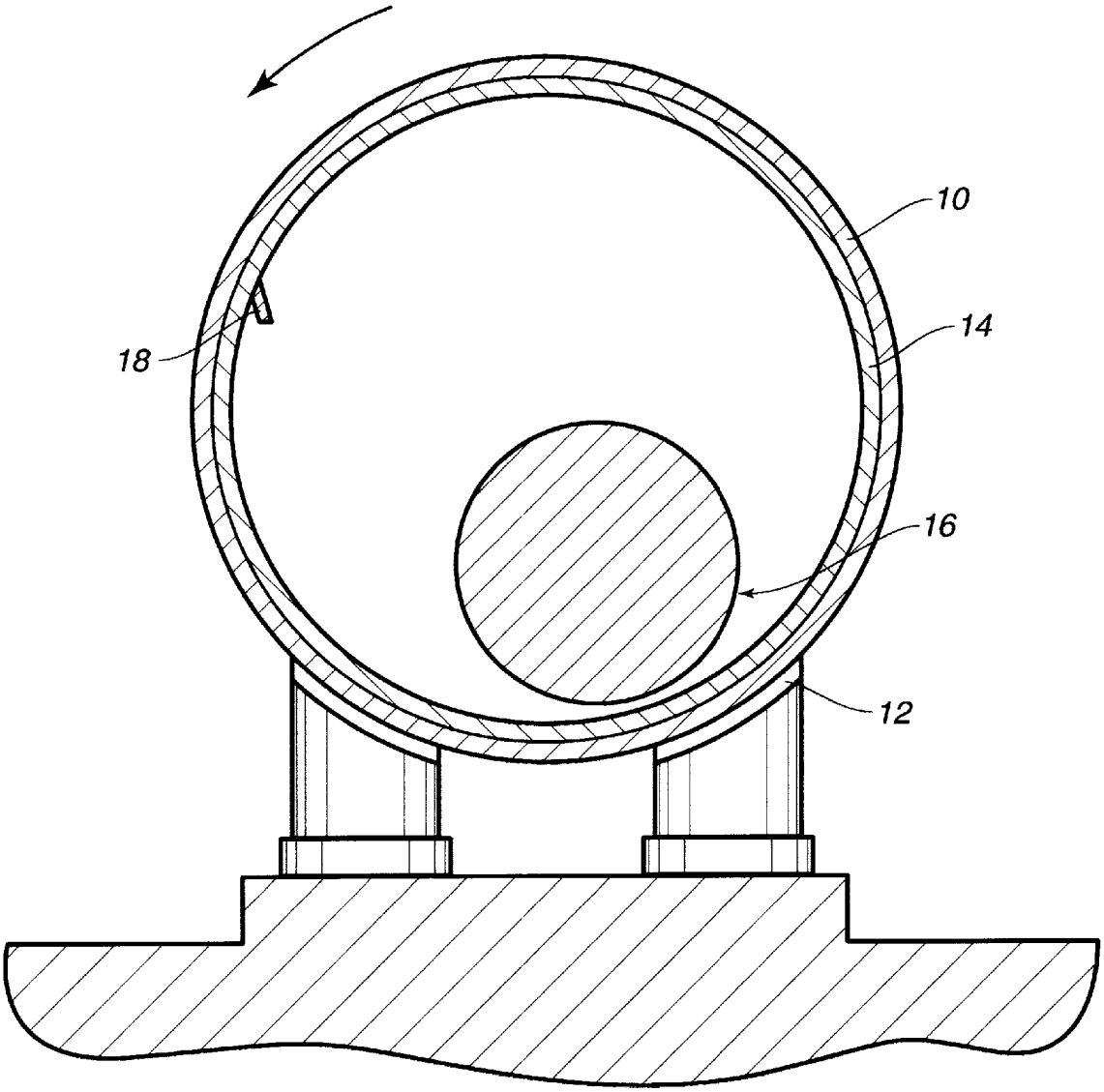
FIG. 2 is a section, through a plane perpendicular to the axis of the grinder of FIG. 1.

The grinder shown in the drawings is constituted by a drum 10, with a horizontal axis, which is supported by shoes or skids 12 enabling it to rotate about its axis ; these shoes could be replaced by a bushing or rollers. The drum is driven in rotation by conventional means, not shown, for example by a motor and a reducer the output shaft of which bears a pinion engaged with a toothed wheel fixed to the drum.

The drum is constituted by a shell internally lined with wear plates which, in the central portion, form an annular grinding track 14, with a cylindrical surface. The interior of the drum is thus divided into a supply area 11, a grinding area 13 and an evacuation area 15. Annular rims 17 provided at the two ends of the shell form barriers enabling a layer of material to be held in the supply and evacuation areas. This drum is closed at its two ends by metal sheets mounted on a fixed support and to which are connected a supply chute, at one end, and a discharge chute and a suction conduit for the pneumatic evacuation of the fine particles, at the other end.

A roller 16 is mounted inside the drum, so as to be able to travel over the track 14 when the drum is driven in rotation. More precisely, when the grinder is in operation, the roller travels over the layer of material covering the track. The roller is provided with two shaft ends mounted in bearings fixed to two levers disposed outside the drums, on either side thereof. Springs or hydro-pneumatic jacks acting on the bearings or on the levers enable the roller to be pressed against the grinding track with a predetermined, adjustable force.

Roller 16 is composed of three frustoconical portions, of different conicity. The main two parts, 16*a* and 16*b*, extend over approximately 80% of the length of the roller; their diameter increases in the direction of progress of the material over the track (direction of the arrow in FIG. 1) and the angle at the apex of part 16*a*, the one closest to the supply area, is greater that of part 16*b*. Part 16*c*, located on the evacuation area side, has a diameter that decreases in the direction of progress of the material and its angle at the apex is markedly greater than that of the other two parts, but less than 100°; the axial length of this part represents between 2% and 20%, preferably between 5% and 15%, of the useful length of the roller. It delimits with the track a decompression area 19 which follows on from the zone for placing the material under pressure between the roller and the track. This decompression area and the layer of material 20 formed in the evacuation area oppose sudden ejection of the material compressed between the track and the roller, close to the edge of the roller, (edge effect). This makes it easier to control crushing in the area adjacent to the decompression area. Furthermore, the decompression area makes it possible to ensure better distribution of the mechanical stresses in the roller close to its lateral face. The thickness of the layer of material 20 formed in evacuation area 15 is such that it practically reaches the edge of the roller in the plane of the edge of the track adjacent to this area.

A device designed to ensure the stepwise forward feeding of the material, from one end of the drum to the other, is disposed in the upper half of the latter, on the descending portion of the circular trajectory of the materials. This device is schematically represented in FIG. 1 by a series of inclined strips 18 which detach from the wall of the drum and the track the material that is normally held there by centrifugal force. The detached material slides over the strips 13 and, owing to their inclination, is moved there from the input towards the output of the grinder. By adjusting the inclination of strips 18, the speed of forward feed of the material is regulated; different speeds can be chosen for the feeding, grinding and evacuation areas. Alternatively, the device for the forward feeding of the material could be of the type described in aforementioned French patent No. 91.09788.

Figure 3:
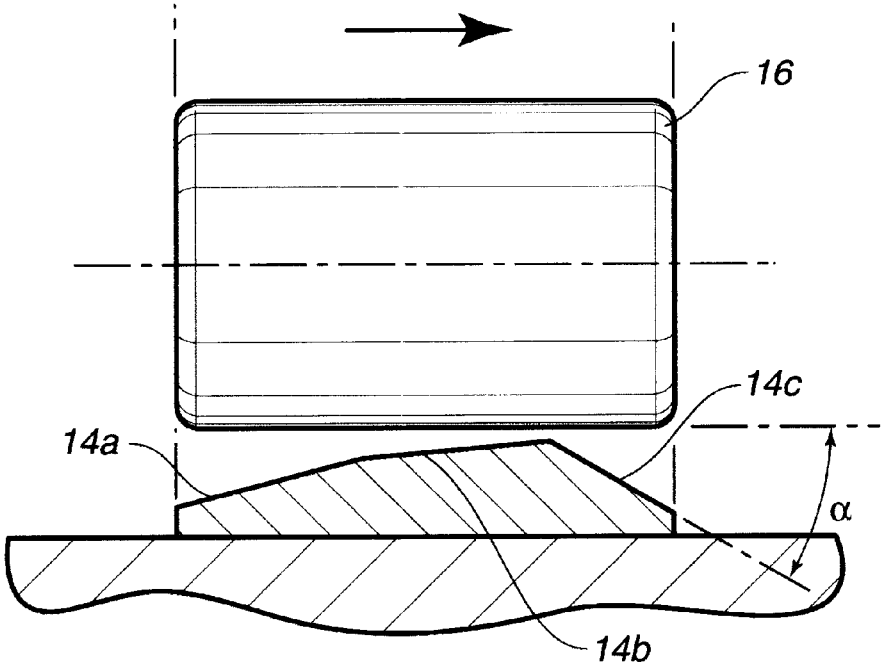
FIGS. 3 and 4 illustrate two other forms of embodiment of the invention.

In FIG. 3 is schematically represented another form of embodiment of the track and the roller. Instead of being cylindrical, the track is formed by three frustoconical surfaces, 14*a*, 14*b* and 14*c* adjoining in such a way that its diameter decreases in the direction of progress of the material indicated by the arrow, over the greater part of its width, and then swiftly decreases in its final portion. The angle at the apex of surface 14*a* is greater than that of surface 14*b*. Surface 14*c* of the track and the roller define the decompression area. In the plane of the figure, which contains the axes of the roller and the track, the angle $\alpha$ formed by this portion of the track and the roller is less than 50°. The surface of roller 16 is cylindrical and its axis is parallel to that of the track.

Figure 4:
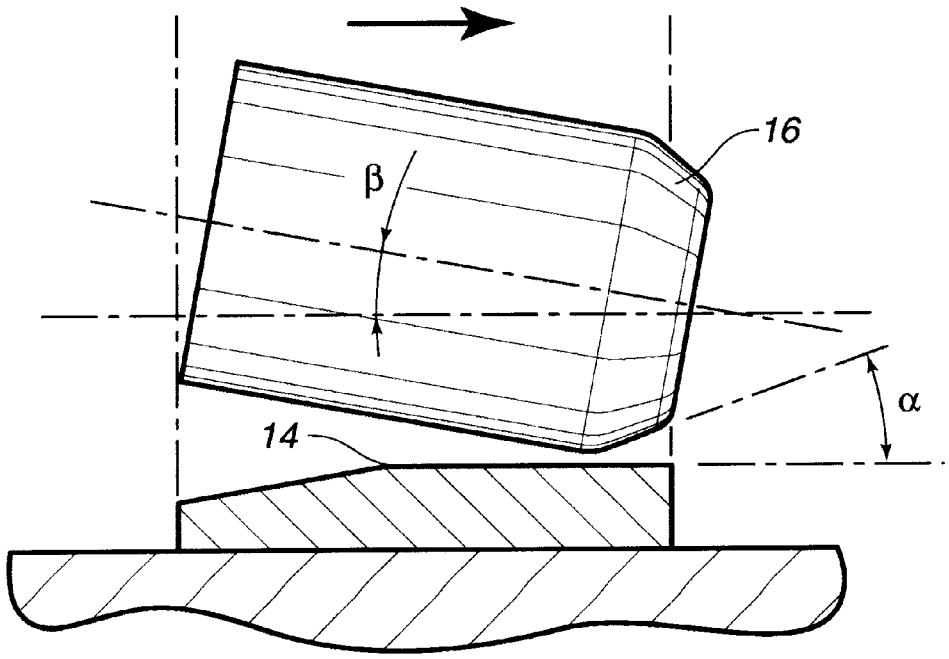

In the form of embodiment shown in FIG. 4, the track comprises a first frustoconical portion, the diameter of which decreases in the direction of progress of the material (arrow), and a second cylindrical portion. The roller is cylindrical and its axis is inclined in relation to the axis of the track by an angle $\beta$°of less than 5°. It comprises at its end adjacent to the evacuation area a frustoconical portion defining, with the track, a decompression area.

Other forms of track and roller can be chosen to obtain a gap that decreases, in the direction of progress of the material, between the track and the roller, over the greater part of the width of the track, and to provide a decompression area on the evacuation area side; it goes without saying that all these forms are within the scope of the invention. It is clear, moreover, that the invention also applies to grinders comprising several rollers on one and the same track or on several tracks.

We claim:

1. Grinder, including at least one annular track with a horizontal axis (14), at least one roller (16) capable of travelling over the said track, means for pressing the roller against the track, and means for displacing the material from one edge to the other of the track in such a way that it passes several times beneath the roller before being discharged, with the gap between the roller (16) and the track (14) decreasing in the direction of advance of the material to be crushed, wherein the said gap between the roller (16) and the track (14) decreases from the edge of the track located on the side of supply of the material to be crushed to a distance from this edge at least equal to 80% of the width of the track, and in that this gap then rapidly increases to form a decompression area (19) on the crushed material discharge side, and in that the track (14) is constituted by a ring integral with a coaxial drum (10) which forms a discharge chamber (15) on one side of the track, and an annular barrier (17) is provided at the end of the discharge chamber the furthest from the track to maintain, in the said chamber, a layer of crushed material the thickness of which is such that it practically reaches the edge of the roller in the plane of the adjacent edge of the track.

2. Grinder according to claim 1, wherein; in the plane containing the axis of the roller and of the track, the angle ($\alpha$) formed by the track and the roller in the decompression area (19) is less than 50°.

3. Grinder according to claim 1 wherein the track (14) is cylindrical and the roller is formed by at least two frustoconical parts, a first part (16*a*, 16*b*) the diameter of which increases from its end located on the supply side to a distance from this end at least equal to 80% of the axial length of the roller, and a second part (16*c*) of decreasing diameter, located at its other end.

4. Grinder according to claim 1 wherein the track is formed by at least two frustoconical surfaces, a first surface (14*a*, 14*b*) the diameter of which decreases from its edge located on the supply side to a distance from this edge at least equal to 80% of the width of the track, and a second surface (14*c*) of a decreasing diameter, adjacent to its other edge.

5. Grinder according to claim 1 wherein the axis of the roller is inclined in relation to the axis of track by an angle ($\beta$) of less than 5°.

* * * * *